United States Patent [19]

Tuckey

[11] 4,036,395

[45] July 19, 1977

[54] SECONDARY SEALING DEVICE FOR STORAGE VESSEL HAVING A FLOATING ROOF

[75] Inventor: James C. Tuckey, Hacienda Heights, Calif.

[73] Assignee: Pacific Erectors Corporation, Sante Fe Springs, Calif.

[21] Appl. No.: 692,750

[22] Filed: June 4, 1976

[51] Int. Cl.[2] ..... B65D 87/207

[52] U.S. Cl. ..... 220/224; 220/226

[58] Field of Search ..... 220/216–227

[56] References Cited

U.S. PATENT DOCUMENTS

| | | | |
|---|---|---|---|
| 2,314,805 | 3/1943 | Wiggins | 220/222 |
| 2,464,804 | 3/1949 | Goldsby et al. | 220/224 |
| 2,471,404 | 5/1949 | Boberg | 220/224 |
| 2,536,019 | 1/1951 | Allen | 220/224 |
| 3,106,309 | 10/1963 | Nelson et al. | 220/222 |
| 3,185,335 | 5/1965 | Lecler | 220/222 |
| 3,275,183 | 9/1966 | Challenger | 220/222 |

FOREIGN PATENT DOCUMENTS

| | | | |
|---|---|---|---|
| 1,267,617 | 5/1968 | Germany | 220/222 |
| 929,723 | 6/1963 | United Kingdom | 220/226 |

*Primary Examiner*—Stephen Marcus

*Attorney, Agent, or Firm*—W. Edward Johansen

[57] ABSTRACT

The present invention is a secondary sealing device for use in a storage vessel having a floating roof and a primary sealing structure that includes a set of steel shoes, each of which is disposed about the perimeter of the floating roof and is mechanically coupled at one of its ends and adapted so that it can contact the inner sidewall of the storage vessel, a set of pushers, each of which is mechanically coupled to the floating roof and to one of the steel shoes and is adapted to apply a constant pressure against the steel shoe so that the side of the steel shoe contacting the inner sidewall of the storage vessel presses against the inner sidewall of the storage vessel. A fabric sealing material which is disposed about the perimeter of the floating roof and secured thereto on one of its sides in a gas-tight manner and secured to the steel shoes contacting the inner sidewall of the cylindrical tank of each hanger in a gas-tight manner and a secondary sealing device has been described. The secondary sealing device includes a support member of an inelastic material having a substantially rectangular cross-section with a support member being mechanically coupled to the steel shoes of the primary sealing structure contacting the inner sidewall of the storage vessel and an elongated inner core member of elastic material having a rectangular cross-section with the core member being secured to the support member and adapted so that the fabric sealing material may be looped over the core member and secured on both sides of the loop to the supporting member.

3 Claims, 5 Drawing Figures

SECONDARY SEALING DEVICE FOR STORAGE VESSEL HAVING A FLOATING ROOF

BACKGROUND OF THE INVENTION

1. Field of the Invention

The present invention relates generally to a liquid storage vessel with an unsecured top and specifically to an above ground gas tight liquid storage tank having a floating roof. More specifically the present invention is a secondary sealing arrangement for use in sealing the oil storage tanks that have been in use until the advent of a deformable seal.

2. Description of the Prior Art

U.S. Pat. No. 3,926,332 entitled *Sealing Structure for a Liquid Storage Vessel Having A Floating Head* issued to Chikashi Y. Okamoto on Dec. 16, 1975, teaches a sealing structure for use in a liquid storage vessel such as an oil storage tank having a floating roof. The sealing structure comprises a hollow resilient core of generally loop form, with a core having a substantially arcuate cross-section which is allowed to contract or expand in its cross-section when subjected to stress as the floating roof moves relative to the body of the storage vessel. This sealing structure is presently the best device for hermetically sealing the tank between the tank body and the floating roof without applying excessive pressure. The difficulty with this device is that it entails refitting all the storage vessels in present use with this new sealing structure. This refitting represents a substantial cost expenditure on the part of the petroleum industry and other industries which require the use of liquid storage vessels with floating roofs.

U.S. Pat. No. 3,106,309, entitled *Secondary Seal for Floating Tank Roof,* issued to William R. Nelson and Marshall U. Bagwell on oct. 8, 1963, teaches a primary seal that includes a number of steel shoes, each of which is supported by and interconnected with the floating roof by a counterweight hanger structure. By appropriate balance of the counterweight the steel shoes of the primary seal are held in contact with the sidewall of the tank as the floating roof rises and falls ih accordance with changes in the amount of the contents stored in the tank. The patent also teaches a secondary seal which is positioned with a slot therein for fitting over the break in the steel shoe for support thereby. The secondary seal is a flexible member, generally rubber or a synthetic resilient material, and is adapted to press against the sidewall of the tank.

U.S. Pat. No. 3,275,183, entitled *Secondary Seal,* issued to Kenneth D. Challenger on Sept. 27, 1968, teaches that in the prior art guide shoes were provided which were attached to the floating roof and which were resiliently biased against the sidewall of the tank. The guide shoes also included a flexible seal member extending from the guide shoe to the sidewall of the tank to prevent foreign material from falling through the annular space into the oil or oil products stored below the floating roof. To further insure against leakage a secondary seal of a resilient material, such as rubber, extending betwen the guide shoes and the sidewall of the tank was also used. The secondary seal had a groove for sealingly engaging the upper edges of the guide shoes and were forced into a sealingly engagement with the sidewall of the tank.

U.S. Pat. No. 2,314,805, entitled *Floating Tank Roof Seal,* issued to John H. Wiggins on Mar. 23, 1943, teaches a floating tank roof seal that includes an annular shoe carried by hangers on the floating roof and arranged vertically in sliding engagement with the sidewall of the tank, and a closure for the space between the roof and the sidewall of the tank constructed so as to provide for relative movement between the roof and the annular shoe while functioning as a primary seal.

Most liquid storage vessels having floating roofs presently use a mechanical seal. The mechanical seal consists of steel shoes pressed against the inner sidewall of a cylindrical tank by a hanger and pusher arrangement mechanically coupled to the floating roof and the steel shoes. Gas-tightness and durability are essentials of oil storage tanks and accordingly the principal requirements for the sealing arrangement of an oil storage tank of the described type are a uniform and a constant pressure between the inner sidewall of the tank and the floating roof, responsiveness to the movement of the floating roof relative to the inner sidewall of the tank, and resistance to wear and abrasion resulting primarily from the friction between the contact surfaces of the inner sidewall of the tank and the sealing structure. If the sealing pressure between the inner sidewall of the tank and the floating roof is deficient, gaps may be produced between the inner sidewall of the tank and the steel shoes although the sealing structure may be subject to lesser wear and abrasion that will result in a prolonged service life of the sealing structure. Oil vapor will therefore escape from the tank through such gaps, causing not only a considerable amount of loss of the stored oil but also the danger of a conflagration or explosion if a spark happens to be produced in the neighborhood of the leaks as in the event of an earthquake. If, conversely, the sealing pressure is excessive, improved sealing of the tank may be achieved and the relative movement between the floating roof and the tank may be accommodated to satisfactorily by the sealing arrangement but the wear and abrasion of the sealing structure will be accelerated resulting in a shortened service life of the sealing arrangement. Other important requirements for the sealing arrangement for the oil storage tank of the described type include: resistance to an undue stress which may be imparted to the sealing structure as a result of upward and downward movements or sways of the floating roof; configurations adapted to match the geometry of the tank and to be readily installed into a working position; and simple, economical and robust construction.

SUMMARY OF THE INVENTION

In view of the foregoing factors and conditions characteristic of the prior art it is a primary object of the present invention to provide an improved secondary sealing structure that is compatible with the primary sealing structure presently in use.

It is another object of the present invention to provide an improved sealing structure for use in a liquid storage vessel having a floating roof so as to achieve complete sealing between the tank and the floating roof of the vessel.

It is still another object of the present invention to provide an improved sealing structure for a liquid storage vessel of the described type wherein the sealing pressure exerted between the tank and the floating roof of the vessel is maintained satisfactorily uniform and constant substantially irrespective of the position of the floating roof relative to the body of the vessel.

It is yet still another object of the present invention to provide an improved sealing structure for use in a liquid storage vessel of the described type which structure is highly responsive to upward and downward movements or sways of the floating roof relative to the body of the vessel so that the floating roof is at all times maintained in a balanced position relative to the vessel body.

It is still yet another object of the present invention to provide an improved sealing structure for use in the liquid storage vessel of the described type, the sealing structure having sufficient resistance to wear and abrasion that will assure a prolonged service life of the sealing structure.

It is still yet another object of the present invention to provide an improved sealing structure for a liquid storage vessel of the described type, wherein the sealing structure is sufficiently resistant to undue stress which may be imparted to the structure as a result of upward and downward movements of the floating roof relative to the body of the vessel.

It is yet still another object of the present invention to provide an improved sealing structure for use in a liquid storage vessel of the described type, which structure is adapted to be readily installed in a working position in the vessel.

It is yet still another object of the present invention to provide an improved sealing structure which is adapted for use specifically in a liquid storage vessel of the described type and which is simple and robust in construction and economical to manufacture.

It is, thus, a general object of the present invention to provide an aboveground gas-tight liquid storage vessel having a floating roof which is hermetically sealed from the body of the vessel by an improved sealing arrangement adapted to provide increased gas-tightness and durability of the storage vessel as a whole and accordingly enhanced assurance of safety required under any local regulations for the prevention of a conflagration or explosion of the vessel in the event of an earthquake or any other disaster.

In accordance with an embodiment of the present invention a secondary sealing device for use in a storage vessel having a floating roof and a primary sealing structure that includes a set of hangers, each of which is disposed about the perimeter of the floating roof and is mechanically coupled at one of its ends and adapted so that it can contact the inner surface of a metal sealing shoe, pressing the metal sealing shoe against the inner sidewall of the storage vessel, a set of pushers, each of which is mechanically coupled to the floating roof and is adapted to apply a constant pressure against the metal sealing shoe so that the metal sealing shoe presses against the inner sidewall of the storage vessel and a fabric sealing material which is disposed about the perimeter of the floating roof and secured thereto on one of its sides in a gas-tight manner and secured to the end of the metal sealing shoe contacting the inner sidewall of the cylindrical tank in a gastight manner and a secondary sealing device has been described. The secondary sealing device includes a support member of an inelastic material having a substantially rectangular cross-section as a support member being mechanically coupled to the end contacting the steel shoes of the primary sealing structure and an elongated inner core member of elastic material having a rectangular cross-section with the core member being secured to the support member and adapted so that the fabric sealing material may be looped over the core member and secured on both sides of the loop to the supporting member.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figure.

DESCRIPTION OF THE PREFERRED EMBODIMENT

Figure 1:
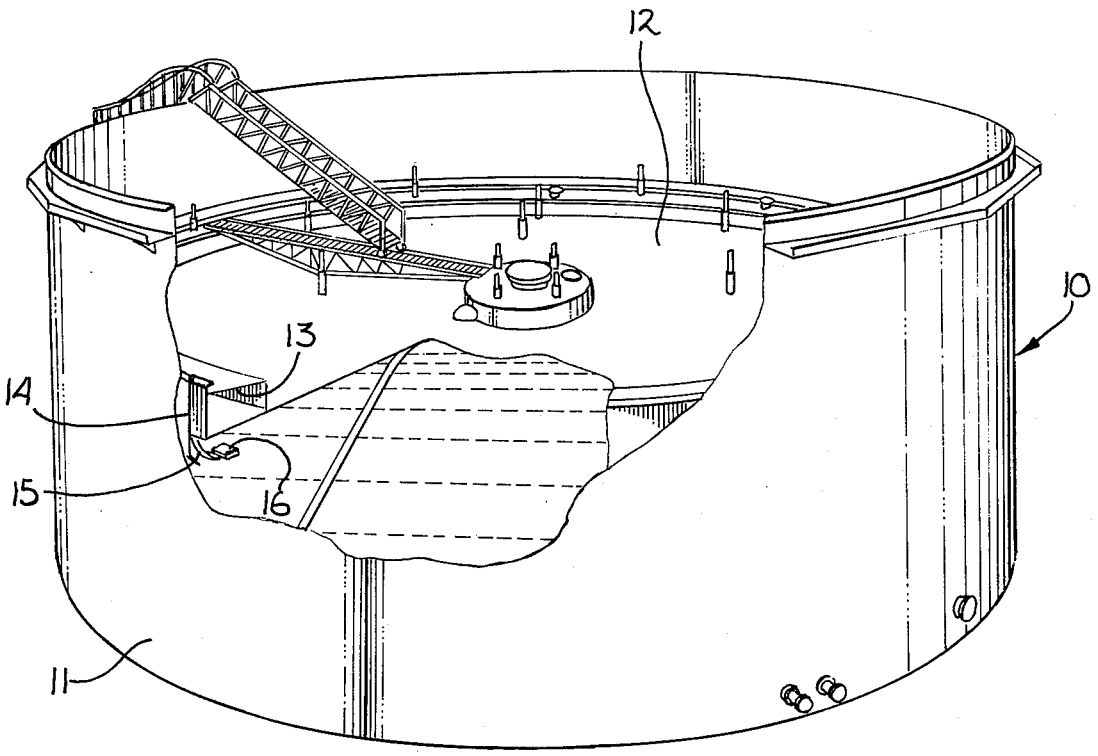
FIG. 1 is a schematic view of a liquid storage vessel that includes a cylindrical tank and a floating roof and which also has a primary sealing structure whose use is widespread in the petroleum industry and a secondary sealing device constructed in accordance with the principles of the present invention.

The present invention can best be understood by reference to FIG. 1 wherein a liquid storage vessel 10 is shown to include a cylindrical tank 11 and a floating circular roof 12. The liquid storage vessel 10 generally contains petroleum products from which gas vapors may escape. The floating circular roof 12 is designed to reduce the amount of gas vapor escaping from the surface of the oil and is also adapted to float on a pontoon 13 which is disposed along the perimeter of the floating circular roof 12 so that it may freely float within the cylindrical tank 11. The floating circular roof 12 has a primary sealing structure for eliminating the flow of gas vapors between the inner sidewall of the cylindrical tank 11 and the perimeter of the floating circular roof 12. The primary sealing structure includes a metal sealing shoe 14, mechanically coupled to the side of the pontoon 13, and a counterweight 16 which is mechanically coupled to the metal band 15 and which presses the metal sealing shoe 14 against the inner sidewall of the cylindrical tank 11.

Figure 2:
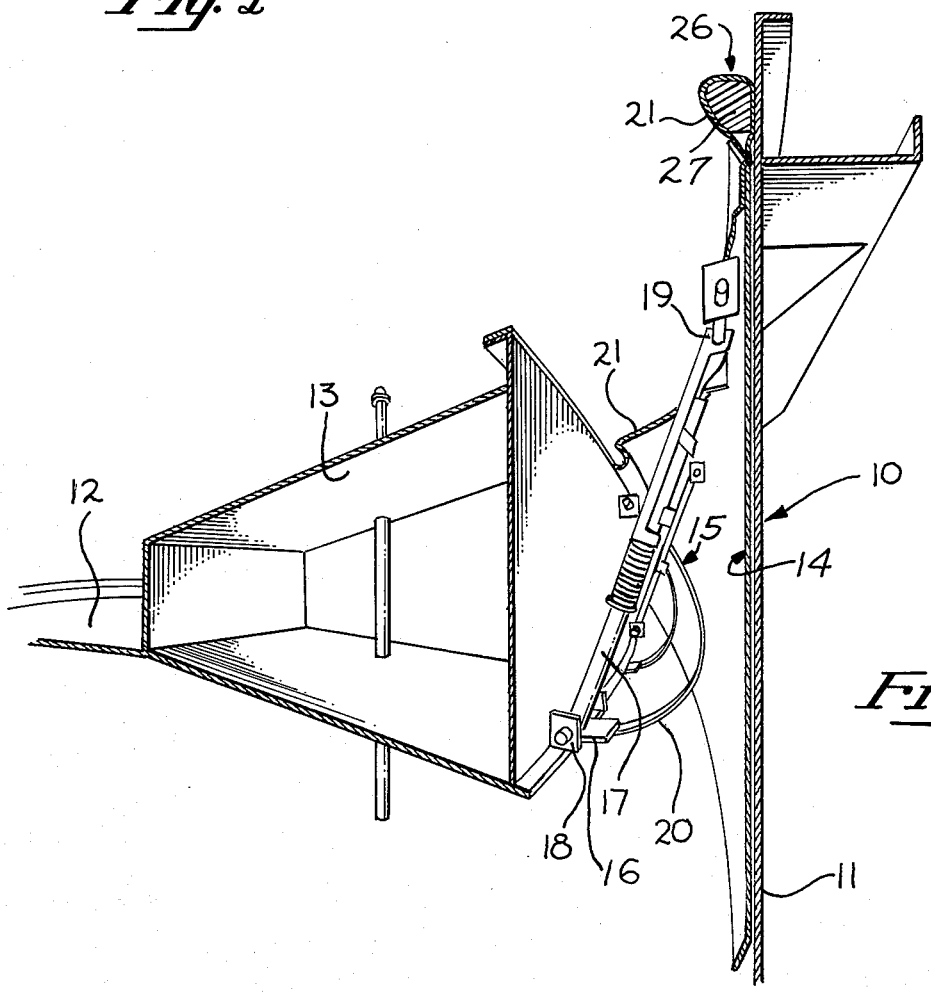
FIG. 2 is schematic drawing of both the primary sealing structure and the secondary sealing device of FIG. 1.

Referring to FIG. 2, the primary sealing structure also includes a hanger 17 having a first end 18 and a second end 19 with the first end being pivotally coupled to the bottom of the pontoon 13, a pusher 15 disposed about the perimeter of the floating circular roof 12 adjacent to the bottom of the pontoon 13 and mechanically coupled to the floating circular roof 12 so that it can apply pressure against metal sealing shoe 14 riding against the inner sidewall of cylindrical tank 1 and a fabric sealing material 21 having a first side 22 and a second side 23 with the first side 22 being disposed about the perimeter of the floating circular roof 12 adjacent to the top of the pontoon 13 in a gas-tight manner and with the second side 23 being secured to the top of the metal sealing shoe 14 in a gas-tight manner.

In operation the metal sealing shoes 14 are disposed about the sidewall of the cylindrical tank 11 and are pressed against the sidewall by the hangers 17, which are coupled at their first ends 18 to the pontoon 13 and at their second ends 19 to the metal sealing shoes 14 in such a manner that each hanger 17 pivots about its first end 18. The metal band 15 is mechanically coupled to the counterweight 16 and near the middle of the hanger and is also mechnically coupled to the hanger 17 in such a manner as exert a downward force thereon. This force is balanced by the metal sealing shoe 15 pressing against the sidewall of the tank and is directed against the hanger 17 at its second end 19 to which it is mechanically coupled. The metal sealing shoes 14 as they are pressed against the sidewall of the tank 11 support the fabric sealing material 21 and are attached to it.

Figure 3:
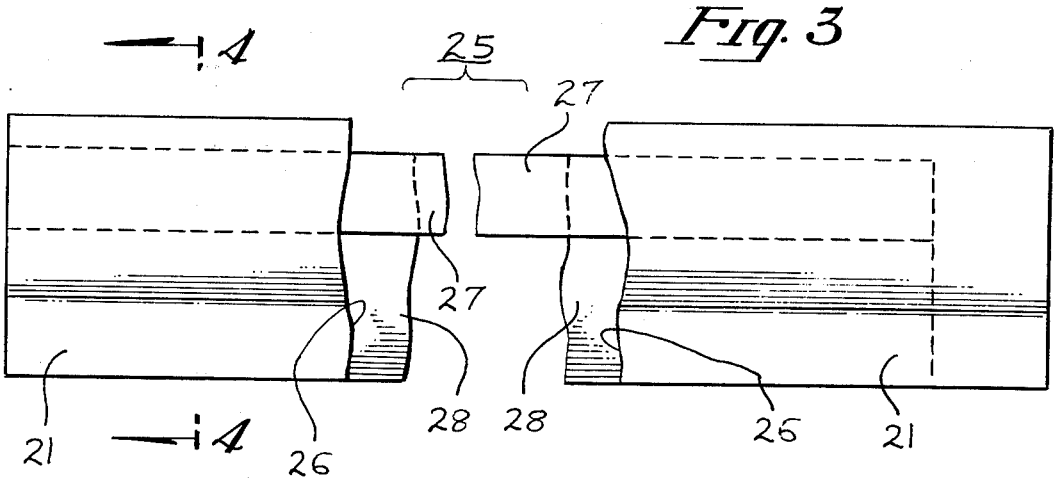
FIG. 3 is a top plan view of the secondary sealing device of FIG. 1.

The present invention is a secondary sealing device 25 which is shown in FIG. 2 but which can be better viewed in FIG. 3. The secondary sealing device 25 includes a portion of the fabric sealing material 21 which has its second side 23 formed into a loop 26 and an inner core member 27 of an elastic material and a support member 28 of an inelastic material, joined together by an adhesive, and disposed within the loop 26 of the fabric sealing material 21. The support member 28 is generally a metal plate having a rectangular cross-section and adpated to being mechanically coupled to the top of the metal sealing shoe 14. The support member 28 is made up of a set of plates which encircle the perimeter of the floating circular roof 12. The inner core member 27 generally include a set of polyurethane sections which are square or rectangular in cross-section and have a length equal to the length of each metal plate.

Figure 4:
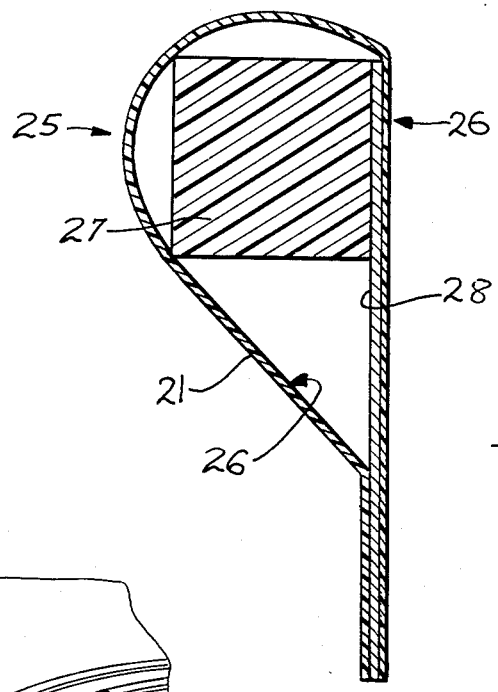
FIG. 4 is a cross-sectional view of the secondary sealing device of FIG. 1 taken along line 4—4 of FIG. 3.

Referring now to FIG. 4 which is a cross-sectional view of the secondary sealing device 25 it can be seen that the support member 28 and the inner core member 27 are disposed within the loop 26 of the fabric sealing material 21. The inelastic support member 28 provides the rigid coupling necessary between the metal sealing shoe 14 and the polyurethane inner core member 27. The elastic inner core member 27 provides the secondary sealing device 25 with the ability to deform as it passes over irregularities in the surface of the inner sidewall of the cylindrical tank 11. Furthermore, the elasticity of the inner core member 27 also provides an even amount of pressure on the fabric sealing material 21 so that not only is friction between the fabric sealing material 21 and the inner sidewall of the cylindrical tank 11 reduced to the minimum, but also the liquid storage vessel 10 is gastight.

Figure 5:
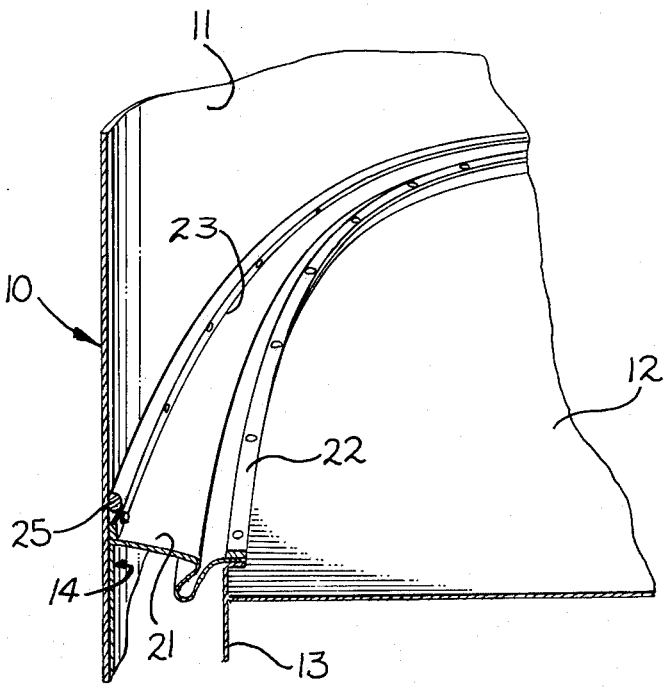
FIG. 5 is a schematic view of the liquid storage vessel of FIG. 1 viewed from the top showing the secondary sealing device in operation.

Referring now to FIG. 5, it can be seen how the secondary sealing device 25 interacts with the primary sealing structure to completely seal off a liquid storage vessel 10. The inner sidewall of the cylindrical tank 11 may have an irregularly shaped surface, but the fabric sealing material 21 slides over the surface as the inner core member 27 deforms itself in order to conform to the surface and to seal the liquid storage vessel 10.

From the foregoing it can be seen that a secondary sealing device for use in a liquid storage vessel having a cylindrical tank and a circular floating roof to operate in conjunction with a primary sealing structure has been described. The secondary sealing device 25 is compatible with the primary sealing structure presently in use in most liquid storage vessels used by the oil industry. Furthermore, by using the secondary sealing device one is able to achieve complete sealing between the cylindrical tank and the floating circular roof and still maintain a satisfactory uniform friction between the inner sidewall of the cylindrical tank and the perimeter of the fabric sealing material.

The advantage of the secondary sealing device is that it not only seals the liquid storage vessel to provide increased gas-tightness and durability, but also it enhances the assurance of safety required under any local regulations for the prevention of a conflagration or explosion of the vessel in the event of an earthquake or any other disaster.

It should be noted that the schematic drawings of the secondary sealing device are not drawn to scale and the distances of and between figures are not to be considered significant.

Accordingly, it is intended that the foregoing disclosure and showing made in the drawing shall be considered only as illustrations of the principles of the present invention.

What is claimed is:

1. In a liquid storage vessel which includes a cylindrical tank and a circular floating roof and which has a primary sealing structure that includes:

a. a pontoon mechanically coupled to the floating roof and disposed about its perimeter;

b. a set of hangers, each of the hangers having a first end and a second end with the first end being mechanically coupled to the pontoon so that the hanger may pivot about its first end;

c. a set of sealing shoes, each of which is disposed about the perimeter of the floating roof and adjacent to the sidewall of the cylindrical tank so that it contacts it and each of which is mechanically coupled to the second end of one of the hangers;

d. a set of metal bands, each of which is mechanically coupled to one of the hangers;

e. a set of counterweights, each of which is mechanically coupled to one of the metal bands so that it exerts a downward force on the hangers; and f. a fabric sealing material disposed about the perimeter of the floating roof and secured thereto on one its sides in a gas-tight manner and mounted adjacent to the sealing shoes in the combination with a secondary sealing device comprising, said secondary sealing device:

a. a support member of an inelastic material having a substantially rectangular cross-section and being of a particular length, said support member being mechanically coupled to the sealing shoe so that the fabric sealing material may contact the inner sidewall of the cylindrical tank;

b. an elongated inner core member of elastic material having substantially a rectangular cross-section and being the same length as said support member, said core member being secured to said support member and adapted so that the fabric sealing material may be looped over said core member and secured on both sides of the loop to said support member.

2. In a liquid storage vessel which includes a cylindrical tank and a circular floating roof and which has a primary sealing structure and a secondary sealing device according to claim 1 wherein said support member comprises a plurality of metal plates, each of which has a rectangular cross-section and is disposed adjacent to the inner sidewall of the cylindrical tank and all of which encircle the floating roof.

3. In a liquid storage vessel which includes a cylindrical tank and a circular floating roof and which has a primary sealing structure and a secondary sealing device according to claim 2 wherein said core member comprises a plurality of rectangularly shaped sections of a length equal to the length of each of said metal plates, each section being formed from a polyurethane material and having a rectangular cross-section and all of said sections encircling the floating roof in order to provide a gas-tight seal.

* * * * *